US006007431A

United States Patent [19]

Bloom, Jr.

[11] Patent Number: 6,007,431

[45] Date of Patent: Dec. 28, 1999

[54] GOLF CLUBS, AND MATCHED SETS THEREOF, WITH FRICTIONALLY-DISSIPATIVE, VIBRATION-DAMPING COUNTERWEIGHTS

[76] Inventor: Walter L. Bloom, Jr., 1281 Beechaven Rd., Atlanta, Ga. 30324-3805

[21] Appl. No.: 09/165,671

[22] Filed: Oct. 2, 1998

Related U.S. Application Data

[63] Continuation-in-part of application No. 08/942,087, Oct. 1, 1997, abandoned, which is a continuation-in-part of application No. 08/908,337, Aug. 7, 1997, abandoned.

[51] Int. Cl.[6] ..... A63B 53/00; A63B 53/14

[52] U.S. Cl. ..... 473/292; 473/297

[58] Field of Search ..... 473/297, 333, 473/291, 292, 316, 318, 549, 457, 256

[56] References Cited

U.S. PATENT DOCUMENTS

| | | | |
|---|---|---|---|
| 1,696,462 | 12/1928 | Victor | 473/297 |
| 2,051,083 | 8/1936 | Hart | 473/297 |
| 2,782,035 | 2/1957 | East | 473/297 |
| 3,075,768 | 1/1963 | Karns | 473/297 |
| 3,606,327 | 9/1971 | Gorman | 473/297 |
| 3,679,207 | 7/1972 | Florian | 473/292 |
| 3,897,058 | 7/1975 | Koch | 473/206 |
| 4,128,242 | 12/1978 | Elkins | 473/291 |
| 4,203,598 | 5/1980 | Stuff | 473/292 |
| 4,415,156 | 11/1983 | Jorgensen | 473/291 |
| 4,461,479 | 7/1984 | Mitchell | 473/292 |
| 4,512,577 | 4/1985 | Solheim . | |
| 4,600,195 | 7/1986 | Hunter | 473/297 |
| 4,621,813 | 11/1986 | Solheim . | |
| 4,674,746 | 6/1987 | Benoit | 473/297 |
| 4,887,815 | 12/1989 | Hughes | 473/291 |
| 4,936,586 | 6/1990 | Raemdonck | 473/297 |
| 4,988,102 | 1/1991 | Reisner | 473/297 |
| 5,082,279 | 1/1992 | Hull | 473/297 |
| 5,087,042 | 2/1992 | Solheim . | |
| 5,152,527 | 10/1992 | Mather | 473/297 |
| 5,193,805 | 3/1993 | Solheim . | |
| 5,228,688 | 7/1993 | Davis | 473/297 |
| 5,244,209 | 9/1993 | Benzel | 473/297 |
| 5,251,901 | 10/1993 | Solheim et al. . | |
| 5,263,718 | 11/1993 | Salheim . | |
| 5,292,122 | 3/1994 | Solheim . | |
| 5,294,037 | 3/1994 | Schmidt . | |
| 5,295,685 | 3/1994 | Solheim . | |
| 5,297,803 | 3/1994 | Solheim . | |
| 5,310,186 | 5/1994 | Karsten . | |
| 5,351,959 | 10/1994 | Duffy | 473/312 |
| 5,362,046 | 11/1994 | Sims . | |
| 5,423,534 | 6/1995 | Solheim . | |
| 5,465,967 | 11/1995 | Boeckenhaupt | 473/297 |
| 5,575,722 | 11/1996 | Saia | 473/318 |
| 5,683,308 | 11/1997 | Monette | 473/318 |
| 5,716,289 | 2/1998 | Okoneski | 473/297 |

OTHER PUBLICATIONS

Jorgensen, Theodore P. "The Physics Of Golf", date:1994 pp. 1–38, 85–95, and 117–122.

Maltby, Ralph "Golfworks 1997 Full Line Catalog", date: 1997 pp. "5–7".

Jorgensen, Theodore P. "On the Dynamics of the Swing of a Golf Club" Book: American Journal of Physics, p. 644.

*Primary Examiner*—Sebastiano Passaniti

*Attorney, Agent, or Firm*—Gardner & Groff, P.C.

[57] ABSTRACT

Golf clubs, and a matched set of golf clubs, with each golf club having a hollow shaft with a head end and grip end. A resilient grip is fitted about the grip end of each shaft, and the grip has a butt end and a forward end and a midpoint therebetween. A clubhead is secured to the head end of each shaft. A frictionally-dissipative, vibration-damping counterweight (dash pot) is positioned within each hollow shaft (except for that of the 1-wood or driver) at the grip end thereof. The counterweight is at least substantially entirely contained between the midpoint and the butt end of the grip. The various counterweights are sized to position the center of gravity of each individual club a selected distance from the head end of the hollow shaft of the individual club, such that the selected distance does not decrease for successively shorter clubs in the matched set.

12 Claims, 3 Drawing Sheets

GOLF CLUBS, AND MATCHED SETS THEREOF, WITH FRICTIONALLY-DISSIPATIVE, VIBRATION-DAMPING COUNTERWEIGHTS

CROSS-REFERENCE TO RELATED APPLICATIONS

The present application is a Continuation-In-Part of U.S. application Ser. No. 08/942,087 filed on Oct. 1, 1997 now abandoned, which in turn is a Continuation-In-Part of U.S. application Ser. No. 08/908,337 filed on Aug. 7, 1997, now abandoned.

TECHNICAL FIELD

The present invention relates to the shafts of golf clubs, to golf clubs, and to sets of golf clubs.

BACKGROUND OF THE INVENTION

Contemporary designers of golf clubs typically intentionally remove weight from the grips and shafts of clubs. In fact, one golf club manufacturer (Goldwin Golf) currently advertises that it has eliminated 40 grams (about 1.6 ounces) of "dead" weight from the grip end of one of its drivers. This design approach is consistent with the beliefs of many that any additional weight in a club can only retard a club's swing speed at impact, and that any weight not in the clubhead thereby necessarily reduces the maximum amount of momentum that the club can transfer to the ball. Because it is based on the idealization of the swinging of a golf club as a simple pendulum, however, this approach overlooks significant subtleties of the physical dynamics of an efficient golf swing.

Recently, T. P. Jorgensen in *The Physics of Golf*, (AIP Press, 1994) has modeled the downswing as the motion of a double pendulum driven by a lateral shift of the leading shoulder and a constant torque applied at the leading shoulder (the higher of the double pendulum's two pivot points). He has labeled his model as a "Standard Model" of the downswing. Further consideration of this model and of its implications for the optimal weighting of golf clubs is discussed in the section herein entitled "Operation."

For more than 50 years, makers of golf clubs have referred to clubs with a higher percentage of their overall weight concentrated in their heads as having greater so-called "swingweight". Strictly speaking, swingweight is a measure of a club's moment of weight about an arbitrary axis, with the axis being located either 14 inches (Lorhythmic Scale, Prorhythmic Scale, et al) or 12 inches (Official Scale) from the butt end of the shaft. On the Lorythmic Scale, one unit of swingweight, which is smaller than any difference that a golfer can feel between two clubs, is roughly equivalent to about 0.065 ounces in the head of a wood or about 0.07 ounces in the head of an iron. Historically, the Official Scale is a revision of the Lorhythmic Scale, which appears to have been chosen, in part, to facilitate the design of a relatively compact device for measuring a moment of weight of golf clubs.

Neither of these scales accurately measures a club's moment of weight about the club's wrist cock axis, which is the axis about which the club actually rotates relative to the leading arm during a swing. In practice, when a golfer grips a club with both hands, the wrist cock axis is located in the vicinity of a righty's left thumb or a lefty's right thumb. Either way, when a golfer grips a club at its full length, we conventionally assume that the wrist cock axis is located about 5 inches from the butt end of the shaft.

In spite of swingweights not being measured relative to the wrist cock axis, however, golf club makers continue to use swingweight as a basis for matching sets of clubs. These matched sets normally progress in even increments of length and weight from longer clubs with lighter heads to shorter clubs with heavier heads. Consequently, a constant swingweight can be maintained by choosing an appropriate common increment in clubhead weight to offset the combined effects of shafts with incrementally decreasing lengths and weights and grips with constant weight.

The traditional method of matching by swingweight also produces sets of clubs for which each club's center of gravity gets closer to the head end of its shaft for successively shorter and heavier clubs. This fact is especially relevant because other inventors previously have patented a variety of non-traditional methods of matching sets of clubs by altering the weights of one or more of the clubs' components. To this inventor's knowledge, however, none of these methods produce sets of clubs for which the centers of gravity do not get closer to the head ends of the shafts for at least some of the clubs in a matched set as the clubs get successively shorter and heavier.

For example, U.S. Pat. No. 4,887,815 to Hughes et al. describes that various weights may be removed from conventional clubheads when counterweights of constant weight are added to produce a set of clubs with significantly reduced but roughly constant swingweights. U.S. Pat. No. 5,152,527 to Mather et al. describes that various weights may be removed from the clubheads, and counterweights of decreasing weight are added to shafts of decreasing length. In U.S. Pat. No. 5,228,688 to Davis it is discussed that conventional lengths and faces of clubs are varied, and counterweights of decreasing weight are added to clubs of decreasing length. In U.S. Pat. No. 4,461,479 to Mitchell, the counterweights for woods are substantial, with those for the 3, 4, and 5-wood in an example exceeding those for any of the irons. The counterweights for successive irons in this same example also progress by too small a common increment (0.10 ounce=2.853 grams) to prevent the centers of gravity of successively shorter clubs from moving progressively closer to the head ends of their shafts.

Considering, next, devices for damping unwanted vibrations of the shafts of golf clubs, we observe that one major shaft manufacturer (True-Temper) recently has introduced shafts with energy-absorbing inserts or liners called SENSICORE™, and a major club manufacturer (Karsten Manufacturing or "Ping") has introduced another vibration-dampening mid-shaft insert known as CUSHIN®. Both of these vibration-damping mechanisms are relatively light in weight and are positioned in the shafts of clubs below the grips.

In U.S. Pat. No. 5,362,046 to Sims it is disclosed that a vibration-damping device is inserted in the butt end of the shafts of clubs. This device, an embodiment of which currently is being marketed as SIMS SHOCK RELIEF™, necessarily incorporates a member that is relatively free to move within the shaft. As disclosed, this device is composed entirely of an elastomer, and the ratio of its head width to its stem length is in the range of 5:1 to 1:1. Thus, it is light in weight, and, except for its vibration damping, has little effect on a club's dynamic response.

The known prior art makes no attempt to design or to use counterweights simultaneously as frictionally dissipative, vibration-damping devices (dash pots) in any of the counterweight devices and systems cited above. Indeed, special care has been taken in all of the patents to affix the counterweights immovably to the interior of shafts. In U.S. Pat. No. 4,461,479 to Mitchell, for example, counterweights are encased tightly in flexible sleeves that, in turn, are bound tightly within clubs' hollow shafts in an effort to insulate the counterweights from mechanical stresses, such as vibrations of the shafts.

Accordingly, a need yet remains for golf clubs and for complete sets of golf clubs with improved overall playability and instructional utility, and which damp or lessen vibration and shock in the user's hands. The present invention is directed principally to the provision of such clubs and sets of clubs.

SUMMARY OF THE INVENTION

The invention disclosed herein comprises improved individual clubs and matched sets thereof, and an improved method for matching sets of clubs in terms of their dynamic responses during the swing. The invention is characterized by adding a frictionally-dissipative, vibration-damping counterweight (dash pot) of an appropriately determined length and weight to the butt end of the shaft for all but the longest of the clubs in a set.

The first of the two principal advantages of this invention is its ability, by virtue of its effects on clubs' overall weights and weight distributions, to promote more efficient applications of torque from the user's arms to the club during the downswing. Such increased efficiency commonly will lead to both greater ball flight distance and greater accuracy, and the invention also increases the ease with which a student can learn an efficient swing technique. The second principal advantage of this invention is its ability to reduce the amplitude of vibrations of the shafts of clubs as commonly result from impact, and especially from off-center impacts.

In fact, the invention achieves the first of the two aforesaid types of advantages by altering the relative magnitudes of the effective physical "moments" according to a very systematic method. As a result of this method of determination, the overall lengths and weights of the counterweights in successive members of a set of clubs typically will increase in roughly even increments from the longest and lightest club to the shortest and heaviest club in the set. As a further result of this method of determination, the distances between each club's center of gravity and the head end of its shaft will not decrease for successively shorter clubs. Of course, such distances typically will differ for sets of irons and woods, and will vary from one set of irons or woods to another depending on the weights and weight distributions of the clubs' other components including clubhead, shaft and grip.

The invention achieves the second of the two aforesaid types of advantages by affording a mechanism to support the rapid frictional dissipation of energy. Specifically, as embodied in this invention, each counterweight is afforded a significant degree of freedom to move small distances. The freedom to move small distances (preferably, longitudinally) is achieved by limiting the frictional contact between each counterweight and the inner surface of its enclosing shaft to the surface area of at least one O-ring, band, or gasket. Preferably, the freedom to move includes the ability to move radially in response to the shaft's vibrations and is achieved by leaving a gap between the outside diameter of a significant portion of the dense and heavily weighted core of the counterweight and the inside diameter of the shaft. In order to increase the dissipation of energy, variants of this invention also may employ O-rings, bands or gaskets composed of elastic, energy absorbing compounds, and may position such components selectively with respect to said dense and heavily weighted core.

DETAILED DESCRIPTION OF THE PREFERRED EMBODIMENTS

Figure 1:
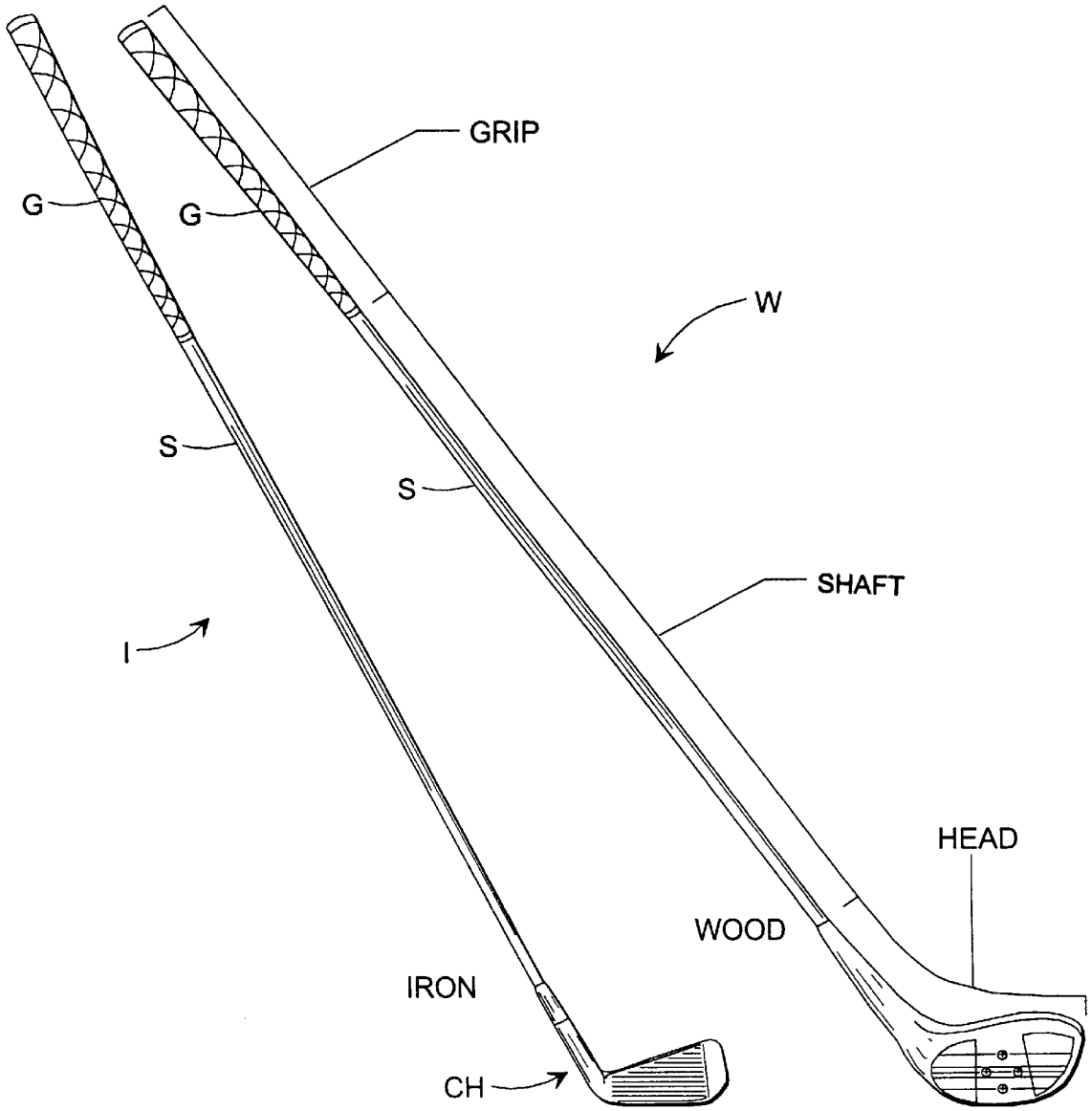
(PRIOR ART) FIG 1
FIG. 1 is an illustration of prior art golf clubs, showing both an iron and a wood.

Referring now to the drawing figures, wherein like reference numerals represent like parts through the several views, FIG. 1 shows a pair of prior art golf clubs—namely an iron I and a wood W. For each, a resilient grip G is fitted snugly over the grip end GE of a hollow shaft S such that, as is conventional in golf clubs, the grip end GE extends essentially to the very butt end of the grip G. A clubhead CH is affixed at the opposite head end HE of shaft S. The present invention comprises a golf club having these same general components—namely, a hollow shaft, a resilient grip slipped over the shaft at one end thereof (the grip end GE) and a clubhead at the opposite end (the head end HE). Importantly, the present invention works a modification in the shaft S in the vicinity of its grip end GE, as will be described in more detail below.

Figure 2:
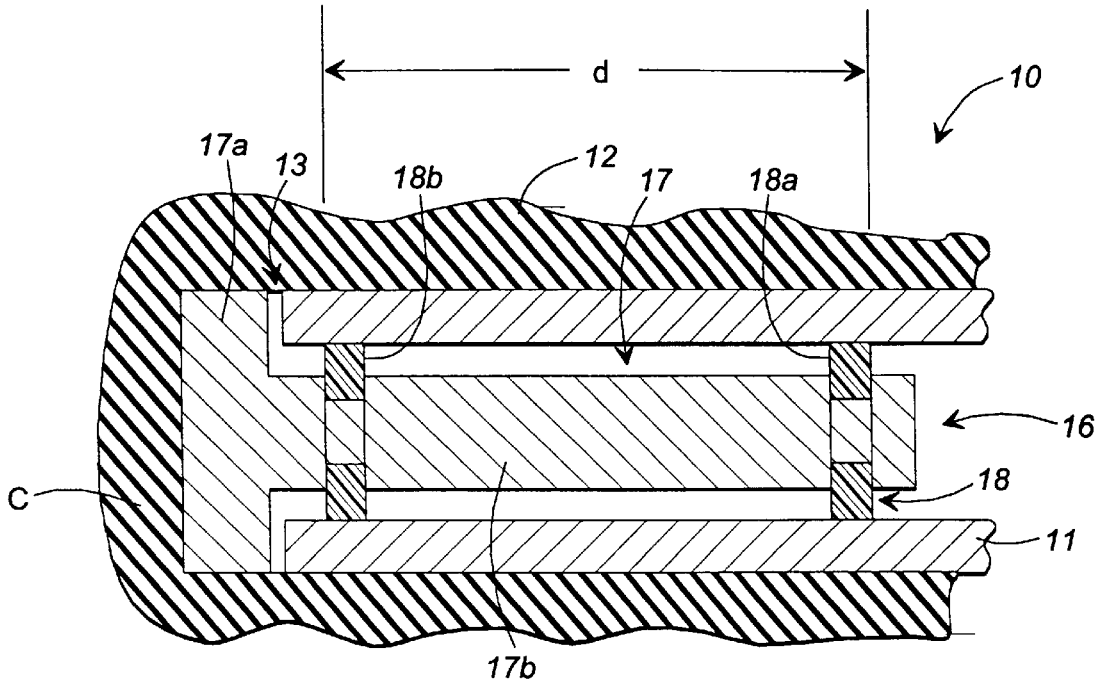
FIG. 2 is a schematic, sectional view of a portion of a golf club according to a first preferred form of the present invention.

FIG. 2 shows a golf club 10 according to a preferred form of the invention. It will be understood by those skilled in the art that the golf club, only a portion of which is shown in FIG. 2, includes a clubhead at the head end (tip) of the shaft 11. The shaft 11 is a hollow shaft and can be made of steel or graphite composite, as is well known in the industry. The grip end of the shaft 11 is covered by a resilient grip 12, the outer contour of which is exaggerated somewhat in FIG. 2. The grip 12 is slipped over the shaft 11 and is held in place with two-sided adhesive tape that is not shown. The shaft 11 terminates at a butt end indicated at 13.

A counterweight assembly 16 is snugly fitted within the interior of the hollow shaft 11 through the butt end 13 thereof. The counterweight 16 includes a first component 17 that is generally plug-shaped, but includes a flanged head 17*a*, to prevent the counterweight assembly 16 from slipping deeper into the shaft 11. Preferably, the first component 17 is made of a dense, heavy metal such as pure lead or tungsten, or of an alloy thereof. The use of a dense, heavy metal such as lead has the advantage of substantially altering the overall weight and moderately altering the moment of weight about the wrist cock axis while only slightly altering the moment of inertia about the wrist cock axis as will be described in more detail below.

The first component 17 of counterweight assembly 16 also includes elongate portion 17*b* that extends into the hollow shaft 11 from the flanged head 17*a*. The outside diameter of this elongate portion 17*b* preferably is roughly at least $1/16^{th}$ inch smaller than the inside diameter of hollow shaft 11. In the preferred form of FIG. 2, the second component 18 of counterweight assembly 16 consists of a set of two O-rings 18*a* and 18*b* spaced a distance d apart. The second component 18 maintains a gap or space preferably roughly at least $1/32^{nd}$ inch wide between the elongate portion 17*b* of component 17 and the inner surface of hollow shaft 11. The gap or space is maintained everywhere except where the two elements of the second component 18 make contact with said inner surface of hollow shaft 11.

In this way, the first component 17 is permitted, in whole and in part, to move small distances both longitudinally and radially within hollow shaft 11. Such movements of counterweight 16 can dissipate a significant portion of the energy that is transmitted through hollow shaft 11 by diminishing the amplitude of vibrations. The invention can thereby soften a club's "impact feel" without eliminating feedback about the position on the clubface of off-center hits.

As shown in FIG. 2, the elongate portion 17*b* of first component 17 of counterweight assembly 16 may include grooves 19*a* and 19*b* for receiving O-rings 18*a* and 18*b*. Said grooves function to prevent said O-rings from changing their respective positions with respect to the longitudinal axis of first component 17. Of course, outer portions of O-rings 18*a* and 18*b* do make contact with and may move with respect to the inner surface of hollow shaft 11. Not only may the exact sizes, shapes, and positioning of O-rings 18*a* and 18*b* influence the vibration-damping function of counterweight 16, but also the distance d of separation between them. Further, while FIG. 2 depicts an open gap between O-rings 18*a* and 18*b*, this gap may be filled with a heavy, viscous material such as plastilene clay in order to provide additional damping of vibrations.

Figure 3:
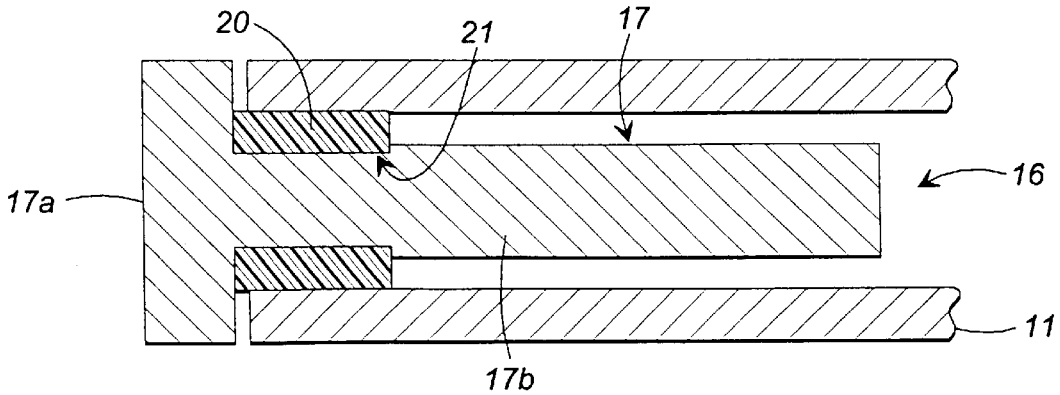
FIG. 3 is a schematic, sectional view of a portion of a golf club according to a second preferred form of the present invention.

FIG. 3 shows another modified form of the invention in which the grip is omitted for clarity of illustration. As shown in FIG. 3, O-rings 18*a* and 18*b* of FIG. 2 are replaced in both substance and function by a single continuous band 20, which band is received in notch 21 on the elongate portion 17*b* of first component 17. Alternatively, although not shown, three or more separate O-rings, bands, or gaskets also may be employed. For both preferred forms shown in FIG. 2 and FIG. 3, the integral cap c on the butt end of resilient grip 12 may make contact with the top and sides of the flanged head 17*a* of first component 17, serving thereby to restrain the movement of counterweight assembly 16 somewhat, and affecting thereby the device's vibration-damping function. Said vibration-damping function also is affected by the elasticity of the second component 18, said elasticity being determined by the material composition of said second component 18. Consequently, component 18 may be composed of advanced vibration materials such as visco-elastic polymers.

Figure 4:
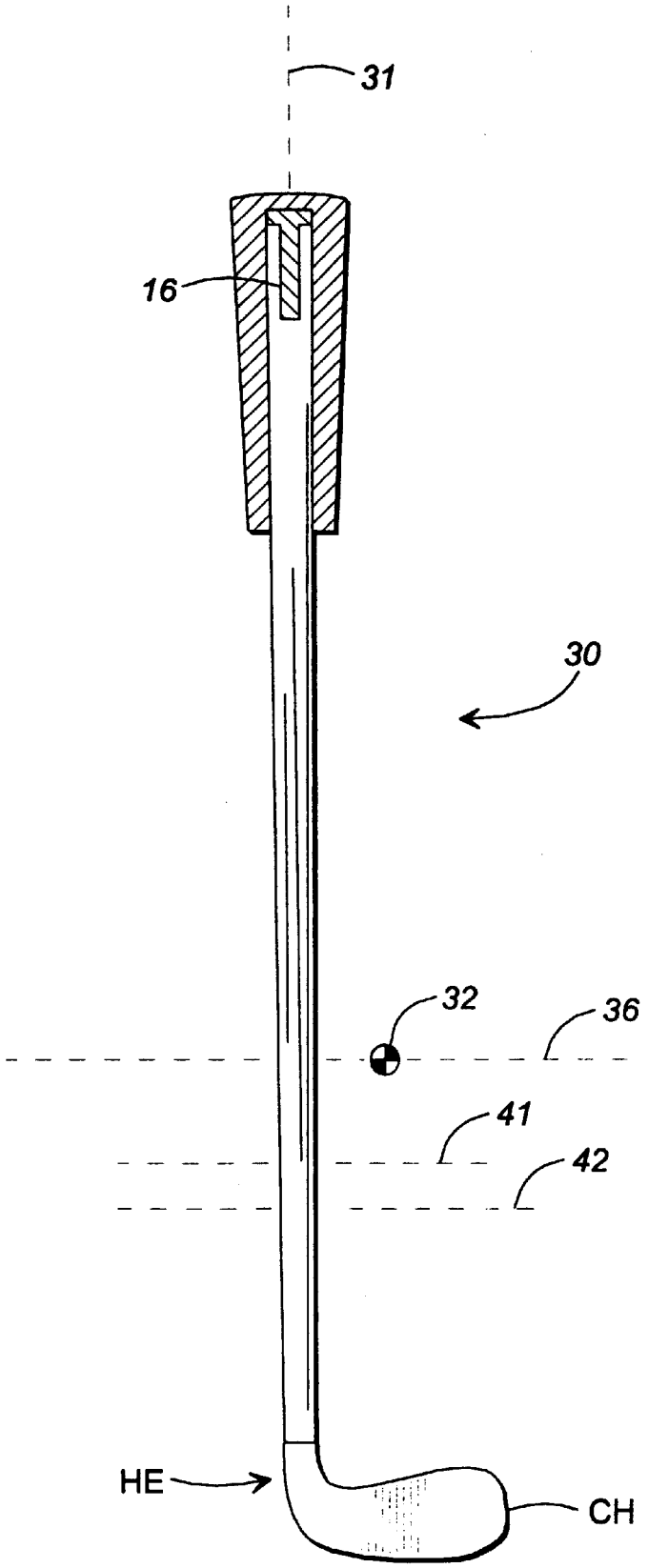
FIG. 4 is a schematic, partly sectional view of the golf club of FIG. 3.

FIG. 4 shows a single club 30 representative of a matched set of such clubs. In order to explain how such sets of clubs traditionally are matched, a little discussion of how they are assembled is in order. As previously mentioned, traditional golf clubs are divided into two subsets by length and by headtype—namely, the "woods" and the "irons."

The shafts of conventional woods for men typically decrease in half-inch increments from a length of 43½ to 44 inches, starting with the 1-wood (or driver) and progressing as far as the 11-wood or even 13-wood in some modern sets. At the same time, the heads of the woods increase in mass in increments of 5 grams per club from a weight of roughly 200 grams for the 1-wood. Since traditional designs maintain a constant grip weight throughout a set of clubs, this results in the moving of the center of gravity closer to the clubhead for each successively shorter wood.

The shafts of typical prior art irons for men conventionally also decrease in half-inch increments from a length of 39½ to 40 inches for a 1-iron to a length of 35½ to 36 inches for a 9-iron or a wedge. The heads of the irons are generally smaller in volume and more dense than the heads of woods. As the length of irons decreases, their heads simultaneously increase in mass in increments of 6 or 7 grams per club from a weight of roughly 225 grams for a 1-iron. This also results in moving the center of gravity closer to the clubhead for each successively shorter iron.

In contrast, FIG. 4 shows a typical club 30 from a matched set according to a preferred form of the invention. Club 30 includes a longitudinal axis 31 extending through the shaft and a transverse axis 36 extending perpendicular to the longitudinal axis 31 and through a center of gravity 32 of said club 30. The length and weight of the first component 17 of counterweight assembly 16 is varied from club to club within the matched set so as to position the transverse axis 36 of each club a selected distance from the head end HE of the hollow shaft 11 of said club 30.

More specifically, the weight of counterweight assembly 16 is selected for each club so that, the weights of the counterweights for successively shorter clubs in a matched set increase in increments of roughly equal magnitudes, said magnitudes ranging in weight from about 8 grams to about 16 grams, and said magnitudes being sufficient so that the distance of separation between transverse axis 32 and head end HE of hollow shaft 11 does not decrease (and may increase) for successively shorter clubs.

As a result, the weights of the counterweights for such a matched set increase incrementally faster than the weights of the clubheads. The specific weights of the counterweights for such a set and the incremental differences therebetween depend not only on the weights of the clubheads, but also on the weights of the clubs' other components, including shafts and grips.

As a further result, the distances of separation between transverse axes 36 and head ends HE of hollow shafts 11 will be greater for sets of clubs with counterweights 16 than for sets without such counterweights 16, except possibly for the longest clubs in such sets. In FIG. 4, transverse axis 36 passes through the center of gravity 32 of a club that includes an embodiment of the invention. This is contrasted with the location of transverse axis 41 passing through the center of gravity of the same club absent the invention, and of transverse axis 42 passing through the center of gravity of the next successively shorter club absent the invention, respectively. Thus, transverse axes 41 and 42 are illustrated for comparison only and do not represent features of the invention itself.

It is important to note that the counterweight assembly 16 extends from the butt end of the shaft toward a midpoint 19 half-way between the butt end 13 of the shaft and the far end of the grip. Indeed, most preferably, the counterweight assembly 16 does not extend beyond the midpoint 19. In a conventional or standard grip, the length of the grip from the butt end 13 of the shaft to the far end (mouth end) of the grip is roughly 11 inches. Thus, for a standard grip, the midpoint 19 would lie approximately 5½ inches from the butt end 13 of the shaft.

The importance of keeping the counterweight shy of this midpoint is, for a given increase in a club's overall weight (or "zeroth moment"), to decrease as much as possible its moment of weight (or "first moment") as measured about its dynamically relevant wrist cock axis. As will be discussed further herein in the section entitled "Operation", said zeroth and first moments act together with a club's moment of inertia (or "second moment") about its wrist cock axis largely to determine the club's dynamic response to input force. Compared to sets of clubs matched traditionally by swingweight, sets of clubs with frictionally-dissipative, vibration-damping counterweights which sets are matched according to the method disclosed herein possess zeroth moments (overall weight) that are substantially greater (as much as 33%), first moments that are slightly less (as much as 4%), and second moments that are only very slightly greater (less than 1%).

To assemble a new club according to the present invention, first the counterweight assembly 16 is assembled from its components, and then it is inserted into the butt end 13 of a hollow shaft 11 of appropriate length to which a clubhead CH previously has been permanently attached. With the counterweight assembly 16 in place in hollow shaft 11, the resilient grip 12 is slipped over said butt end of said shaft, where it is adhered conventionally by means of double-sided adhesive tape (not shown), to achieve the configuration of FIG. 2. Of course, to modify existing clubs to incorporate an appropriate counterweight, the old grip first must be removed before said counterweight can be inserted into the butt end of the shaft, and a new grip can be installed.

OPERATION

For successively shorter and heavier clubs, the method of matching disclosed herein uses frictionally dissipative, vibration-damping counterweights (dash pots) that increase in weight in roughly equal increments that are sufficiently large to produce sets of clubs for which the distance between each club's center of gravity and the head end of its shaft never decreases. Further, since no increase in simulated clubhead speed can be realized at impact by adding counterweights to the longer woods (1-wood through 5-wood), the method of matching disclosed herein typically does not add any counterweight whatsoever to the longest club—that is, to the 1-wood or driver. The counterweights that are added to successively shorter and heavier clubs then increase in increments of roughly equal magnitudes, said magnitudes being greater than the incremental increases in head weights of successively shorter clubs—that is they are in the range of from about 8 grams to about 16 grams depending on the weights of the clubs' other components.

In order to realize this invention's weight-related improvements with respect to the specific instructional value of individual golf clubs as well as to the overall playability of sets of clubs, this inventor has carefully studied Theodore P. Jorgensen's aforementioned "Standard Model" of the downswing. Jorgensen has published and implemented this model in a variant of the BASIC programming language, and has derived appropriate inputs by making reasonable assumptions concerning a single professional golfer's proportions and strengths and by fitting the model's outputs closely to empirical data derived from stroboscopic photographs of the golfer swinging a driver.

Jorgensen's "Standard Model" analysis clearly demonstrates that his professional's downswing, which is assumed to have been efficient, lasted only for about 0.25 seconds and was characterized by two regions of roughly constant acceleration of the clubhead, each lasting about 0.10 seconds. In between these two regions, an interval lasting only about 0.05 seconds accounted for a roughly 3-fold increase in the rate of acceleration. Most significantly, the beginning of this intermediate 0.05-second interval coincided with the commencement of the uncocking of the golfer's wrists, while its ending coincided with the golfer's switching from accelerating to decelerating the lateral shift of the leading shoulder. In other words, the golfer actually was, in some sense, completing the winding up of the arm/club system during the first 0.10 seconds and was releasing as much stored energy as possible into the motion of the clubhead during the last 0.10 seconds prior to impact.

A careful examination by the present inventor/applicant of the "Standard Model" also led him to realize an extremely important revelation. Namely, at the end of the initial 0.10-second region, a very important switch takes place between the relative importance of the club's first and second moments. Specifically, during the downswing's first 0.10 seconds, angular accelerations are the dominant dynamic variables and the club's second moment is its dominant moment. In other words, the relative absolute magnitudes of the component torques associated with these two types of variables are greater during this initial period than the magnitudes of any other component torques.

In contrast, from the 0.10-second mark almost all the way to impact, component torques resulting from the interaction of angular velocities and the club's first moment are dominant. Thus, by increasing clubs' second moments less than 1% while decreasing their first moments from five to six times as much in percentage terms, this invention inclines golfers to complete their windup more slowly during the first 0.10 seconds or so of the downswing, and to release the clubhead to swing through more rapidly thereafter, and especially during the last 0.10 seconds prior to impact.

Golf instructors commonly refer to the highly desirable consequence of these effects as "late hitting." According to Jorgensen's model, not only should the pattern of changes to clubs' first and second moments that result from this invention contribute consistently to such "late hitting," but also, for clubs with appropriately weighted components, they should maximize clubhead speed at impact for all but the longest clubs, with greatest increases for the middle irons (5, 6, & 7-iron). And, since the middle irons are precisely those clubs most commonly used for instruction of beginners and others with inefficient swings, these changes are of special instructional value.

More specifically, during the downswing, golfers with inefficient swings typically begin to unwind too rapidly and, as a consequence, commonly apply too much torque too soon at the leading shoulder. This causes the uncocking of the wrists to begin too soon, and to proceed too rapidly. Another consequence is that golfers with inefficient swings also commonly are unable to apply torque efficiently to the leading arm immediately prior to impact while rotating the forearms to the appropriate extend in a timely manner.

Another original consequence of the invention disclosed herein is intentionally to produce larger differences in "swing feel" between successive clubs than those of a set matched by swingweight. Thus, the method disclosed herein is antithetical in essential ways to Jorgensen's own patented method of matching sets of clubs (U.S. Pat. No. 4,415,156), which prior method is intended to give all clubs nearly identical moments. Specifically, the invention disclosed herein increases zeroth moments (overall weights) more and more for successively shorter clubs while preserving a reciprocal, linear relationship between first and second moments with slightly smaller first moments and very slightly larger second moments compared to sets of clubs matched by swingweights. As a result, this inventor believes that the method of matching disclosed herein represents a substantial improvement over the conventional method of matching by swingweight.

The importance of preserving a reciprocal, linear relationship between first and second moments for successively shorter clubs stems from the fact that one swings them at successively slower speeds through successively shorter arcs with successively less change in wrist cock angles. These reductions, in turn, require reduced lateral shifts and reduced input torques at the leading shoulder. Because shorter clubs aren't swung as far and wrists don't cock as much, second moments need not be so large. Because the clubheads of shorter clubs do not need to swing around either as far or as fast to impact, first moments need not be so small. In an important sense, then, the invention disclosed herein "fine tunes" the reciprocal, linear relationship between first and second moments for successively shorter clubs, which linear relationship appears to be so essential to sets of clubs matched by swingweights.

Finally, the invention's frictionally dissipative, vibration-damping capabilities are intended to contribute further to the overall playability of golf clubs by substantially softening "impact feel" without significantly altering useful frequency-based feedback from off-center hits.

While the invention has been disclosed in preferred forms, it will be apparent to those skilled in the art that various modifications, additions, and deletions can be made therein without departing from the spirit and scope of the invention as set forth in the following claims.

I claim:

1. A golf club comprising:

a hollow shaft having a head end and a grip end;

a resilient grip fitted about said grip end of said shaft, said grip having a butt end, a forward end, and a midpoint therebetween;

a club head rigidly secured to said head end of said shaft; and a counterweight positioned within said hollow shaft at said grip end thereof, said counterweight comprising a first component and a second component, said first component contained at least in part within said second component, said first component being contained within said hollow shaft by said second component loosely enough so as to be able to move small distances relative to said second component and said hollow shaft;

wherein said first component comprises a first portion sized to be larger than an inside diameter of said grip end of said hollow shaft so as to limit insertion of said counterweight into said hollow shaft, and a second portion extending from said first portion and sized to be smaller than the inside diameter of said shaft so that a gap is established between said second portion and an inside surface of said hollow shaft.

2. A golf club as claimed in claim 1 wherein said counterweight is at least substantially entirely contained between said forward end and said butt end of said grip.

3. A golf club as claimed in claim 1 wherein said counterweight is at least substantially entirely contained between said midpoint and said butt end of said grip.

4. A golf club as claimed in claim 1 wherein said first component comprises a material having a density at least as great as steel.

5. A golf club as claimed in claim 1 wherein said second component comprises at least one ring-shaped, non-rigid guide.

6. A golf club as claimed in claim 5 wherein said ring-shaped guides are made from a visco-elastic, energy-absorbing compound.

7. A matched set of golf clubs comprising:

a plurality of individual clubs each comprising a hollow shaft having a head end and a grip end, a resilient grip fitted about said grip end, and a clubhead rigidly secured to said head end; and a plurality of individual counterweights fitted within said plurality of individual clubs, said counterweights having a size and weight selected so as to position the center of gravity of each individual club a selected distance from said head end of said individual club's hollow shaft such that said selected distance does not decrease for successively shorter clubs in said matched set;

each of said counterweights comprising a first component and a second component;

wherein said first component comprises a first portion sized to be larger than an inside diameter of said grip end of said hollow shaft so as to limit insertion of said counterweight into said hollow shaft, and a second portion extending from said first portion and sized to be smaller than the inside diameter of said shaft so that a gap is established between said second portion and an inside surface of said hollow shaft.

8. A matched set of golf clubs as claimed in claim 7 wherein the weights of said counterweights are varied in a manner such that said selected distance does not decrease for successively shorter clubs in the matched set.

9. A matched set as claimed in claim 8 wherein the weights of said counterweights increase in roughly even increments for successively shorter clubs.

10. A matched set as claimed in claim 9 wherein the weights of said counterweights increases faster than do the weights of said clubheads.

11. A matched set of golf clubs as claimed in claim 9 wherein the length of said counterweights are varied in a manner such that said selected distance does not decrease for successively shorter clubs in the matched set.

12. A method of matching a set of golf clubs, each of the clubs comprising a hollow shaft having a head end and a grip end, a resilient grip fitted about said grip end, and a club head rigidly secured to the head end, the method comprising the steps of:

providing a counterweight positioned within said hollow shaft of each club in the matched set, said counterweight having a first component and a second component, wherein said first component comprises a first portion sized to be larger than an inside diameter of said grip end of said hollow shaft so as to limit insertion of said counterweight into said hollow shaft, and a second portion extending from said first portion and sized to be smaller than the inside diameter of said shaft so that a gap is established between said second portion and an inside surface of said hollow shaft;

selecting said counterweights of select weights to position the center of gravity of each individual club a certain distance from the head end of the hollow shaft for each individual club such that said certain distance does not decrease for successively shorter clubs in the matched set;

inserting the counterweights into the grip ends of the golf clubs in the matched set.

* * * * *